US009541856B2

(12) United States Patent
Ikazaki et al.

(10) Patent No.: US 9,541,856 B2
(45) Date of Patent: Jan. 10, 2017

(54) IMAGE FORMING APPARATUS WITH FUNCTION OF SETTING APPROPRIATE DEVELOPMENT BIAS

(71) Applicant: KYOCERA Document Solutions Inc., Osaka-shi, Osaka (JP)

(72) Inventors: Shizuka Ikazaki, Osaka (JP); Akihiro Watanabe, Osaka (JP); Tamotsu Shimizu, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/642,062

(22) Filed: Mar. 9, 2015

(65) Prior Publication Data

US 2015/0261124 A1 Sep. 17, 2015

(30) Foreign Application Priority Data

Mar. 14, 2014 (JP) ..... 2014-052226

(51) Int. Cl.
*G03G 15/06* (2006.01)
*G03G 15/08* (2006.01)

(52) U.S. Cl.
CPC ..... *G03G 15/065* (2013.01); *G03G 15/0803* (2013.01)

(58) Field of Classification Search
CPC ..... G03G 15/065
See application file for complete search history.

(56) References Cited

U.S. PATENT DOCUMENTS 8,705,127 B2 * 4/2014 Koyatsu ..... G03G 15/0126 358/1.1
2003/0175055 A1 * 9/2003 Machida ..... G03G 15/0808 399/285
2008/0187337 A1 * 8/2008 Kim ..... G03G 15/065 399/55

(Continued)

FOREIGN PATENT DOCUMENTS

JP 61167965 A * 7/1986
JP 2003-287942 10/2003

*Primary Examiner* — Clayton E Laballe
*Assistant Examiner* — Noam Reisner
(74) *Attorney, Agent, or Firm* — Gerald E. Hespos; Michael J. Porco; Matthew T. Hespos

(57) ABSTRACT

An image forming apparatus includes an image carrier, a developer carrier, a bias applying section, a leakage detecting section, and a bias controlling section. The developer carrier carries developer in the form of a layer of magnetized filaments to supply toner to the image carrier. The bias applying section applies to the developer carrier a development bias including a direct current voltage VmagDC and an alternating current voltage VmagAC superposed on each other. The leakage detecting section causes a discharge between the image carrier and the developer carrier and detects a leakage voltage when the discharge occurs. The leakage detecting section performs the leakage voltage detection in a blank region of the image carrier bearing no electrostatic latent image. The bias controlling section determines an alternating current voltage VmagAC according to a detected leakage voltage, and a frequency of the alternating current voltage VmagAC according to the voltage VmagAC.

5 Claims, 5 Drawing Sheets

(56) References Cited

U.S. PATENT DOCUMENTS

2010/0129102 A1* 5/2010 Fujihara ..... G03G 15/065
399/55
2014/0294424 A1* 10/2014 Liu ..... G03G 15/0233
399/89

* cited by examiner

FIG. 4

| MAGNETIC ONE-COMPONENT | | FREQUENCY (kHz) | | | | | | | | |
|---|---|---|---|---|---|---|---|---|---|---|
| | | 2.5 | 2.3 | 2.1 | 1.9 | 1.7 | 1.5 | 1.3 | 1.1 | 0.9 |
| Vpp(kV) | 2.0 | IMAGE OK ZONE | | | | FOGGING NG ZONE | | | | |
| | 1.8 | | | | | | | | | |
| | 1.6 | | | | | | | | | |
| | 1.4 | | | | | | | | | |
| | 1.2 | GHOSTING NG ZONE | | | | | | | | |
| | 1.0 | | | | | | | | | |
| | 0.8 | INSUFFICIENT DENSITY NG ZONE | | | | | | | | |

FIG. 5

| TWO-COMPONENTS | | FREQUENCY (kHz) | | | | | | | | | | |
|---|---|---|---|---|---|---|---|---|---|---|---|---|
| | | 10 | 9.0 | 8.0 | 7.0 | 6.0 | 5.0 | 4.0 | 3.0 | 2.0 | 1.0 | 0.8 |
| Vpp(kV) | 2.0 | GHOSTING NG ZONE | | | | IMAGE OK ZONE | | | FOGGING NG ZONE | | | |
| | 1.8 | | | | | | | | | | | |
| | 1.6 | | | | | | | | | | | |
| | 1.4 | | | | | | | | | | | |
| | 1.2 | | | | | | | | | | | |
| | 1.0 | | | | | | | | | | | |
| | 0.8 | INSUFFICIENT DENSITY NG ZONE | | | | | | | | | | |

IMAGE HAVING GHOSTING

IMAGE HAVING NO GHOSTING

IMAGE FORMING APPARATUS WITH FUNCTION OF SETTING APPROPRIATE DEVELOPMENT BIAS

INCORPORATION BY REFERENCE

This application is based on Japanese Patent Application No. 2014-52226 filed with the Japan Patent Office on Mar. 14, 2014, the contents of which are hereby incorporated by reference.

BACKGROUND

The present disclosure relates to an image forming apparatus employing a developing method of supplying developer from a developer carrier carrying a layer of magnetized filaments to an image carrier carrying an electrostatic latent image.

In an image forming apparatus employing an electrophotographic method, such as a copier, printer or facsimile machine, developer is supplied from a developing roller to an electrostatic latent image formed on a photosensitive drum to develop the electrostatic latent image, thereby forming a toner image on the photosensitive drum. A development bias is applied to the developing roller. In some cases, the development bias includes an alternating current voltage and a direct current voltage that are superposed on each other. In order to set an appropriate development bias in such a case, there is known a technology of detecting a leakage voltage between the photosensitive drum and the developing roller.

SUMMARY

An image forming apparatus according to an aspect of the present disclosure includes an image carrier, a developer carrier, a bias applying section, a leakage detecting section, and a bias controlling section.

The image carrier includes a circumferential surface for carrying an electrostatic latent image and a toner image. The developer carrier includes a magnetic member therein and a circumferential surface for carrying a developer containing toner in the form of a layer of magnetized filaments to supply toner from the layer of magnetized filaments to the image carrier for development of the electrostatic latent image. The bias applying section applies to the developer carrier a development bias including a direct current voltage VmagDC and an alternating current voltage Vmag AC that are superposed on each other. The leakage detecting section causes a discharge between the image carrier and the developer carrier and detects a leakage voltage when the discharge occurs. The bias controlling section controls the development bias for the image formation and the leakage voltage detection.

The leakage detecting section performs the leakage voltage detection in a blank region of the image carrier, the blank region bearing no electrostatic latent image. The bias controlling section controls the development bias to change based on a leakage voltage by determining an alternating current voltage VmagAC according to a detected leakage voltage and determining a frequency of the alternating current voltage VmagAC according to the alternating current voltage VmagAC.

These and other objects, features and advantages of the present disclosure will become more apparent upon reading the following detailed description along with the accompanying drawings.

BRIEF DESCRIPTION OF THE DRAWINGS

FIG. 4 is a table showing a relationship between development alternating current voltages and frequencies thereof and image qualities in the case of using a magnetic one-component developer.

FIG. 5 is a table showing a relationship between development alternating current voltages and frequencies thereof and image qualities in the case of using a two-component developer.

DETAILED DESCRIPTION

Figure 1:
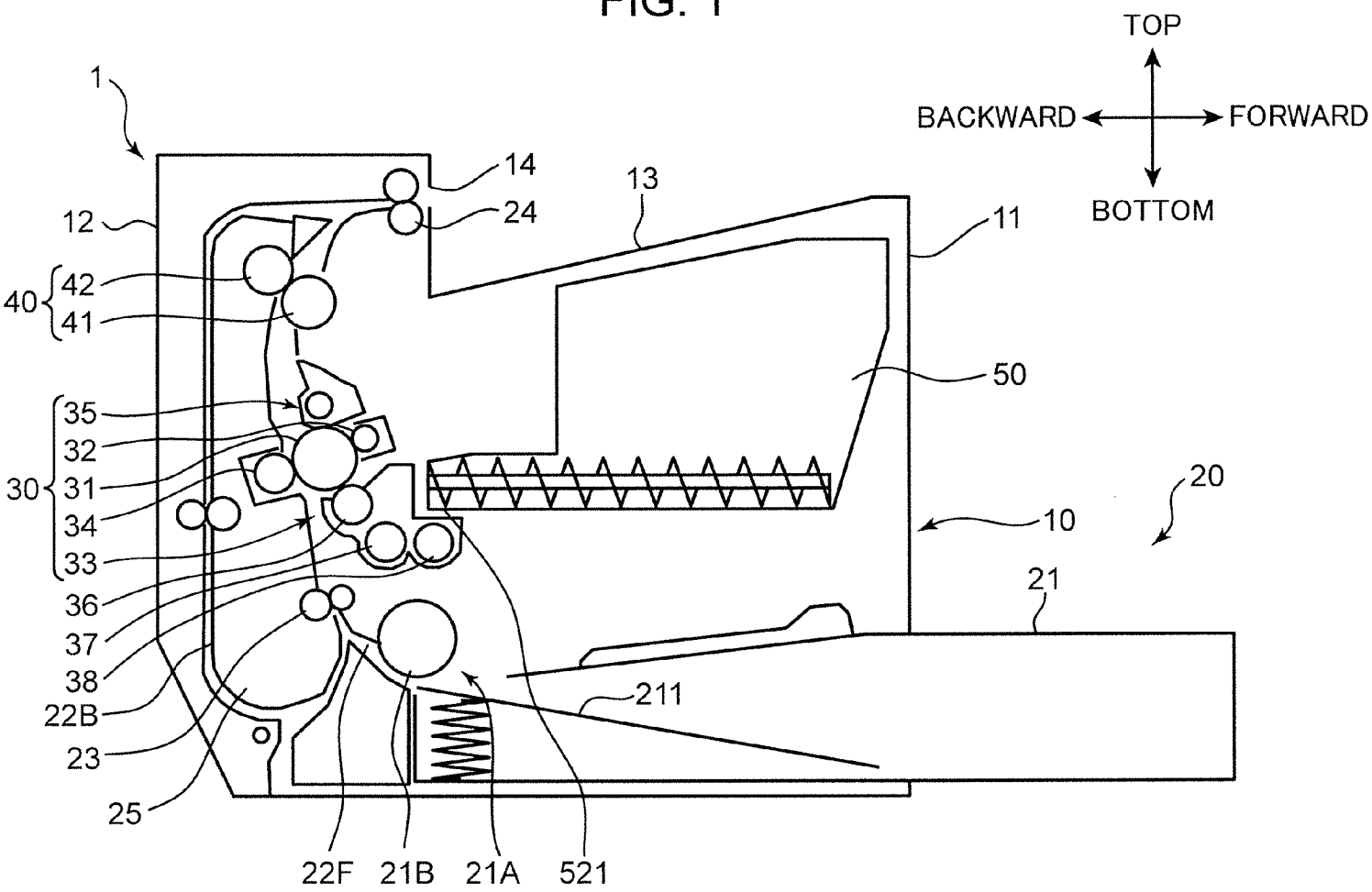
FIG. 1 is a sectional view showing an embodiment of an image forming apparatus according to the present disclosure.

Hereinafter, an embodiment of the present disclosure will be described in detail with reference to the accompanying drawings. FIG. 1 is a sectional view showing an internal structure of an image forming apparatus 1 according to an embodiment of the present disclosure. Here, the image forming apparatus 1 will be illustrated as a monochrome printer, but it may alternatively be provided as a copier, color printer, facsimile machine or multifunction machine equipped with all of these functions.

The image forming apparatus 1 includes a main housing 10 having a substantially rectangular parallelepiped casing structure, and a sheet feeding section 20, an image forming section 30, a fixing section 40, and a toner container 50 which are housed in the main housing 10.

The main housing 10 includes a front cover 11 on a front side thereof and a rear cover 12 on a rear side thereof. The toner container 50 can be removed from the front of the main housing 10 by opening the front cover 11. The image forming section 30 and the fixing section 40 each can be removed from the rear of the main housing 10 by opening the rear cover 12. An upper surface of the main housing 10 includes a discharge section 13 to which a sheet having been subjected to image formation is discharged.

The sheet feeding section 20 includes a sheet feeding cassette 21 for storing sheets to be subjected to image formation. The sheet feeding cassette 21 includes a sheet storage space for storing a stack of the sheets, and a lift plate 211 for lifting the stack of sheets for feeding a sheet is provided in the sheet storage space. A sheet feeder 21A is provided above a rear end of the sheet feeding cassette 21. The sheet feeder 21A includes a sheet feeding roller 21B for feeding sheets one by one from the top of the stack of sheets.

The image forming section 30 performs the image formation of forming a toner image on a sheet fed from the sheet feeding section 20. The image forming section 30 includes a photosensitive drum 31 (image carrier), and a charging device 32, an exposure device (not shown in FIG. 2), a developing device 33, a transfer roller 34, and a cleaning device 35 which are disposed around the photosensitive drum 31.

The photosensitive drum 31 includes a circumferential surface 31S (FIGS. 2 and 3) for allowing an electrostatic latent image to be formed thereon and carrying a toner image corresponding to the electrostatic latent image. The photosensitive drum 31 may be made of an amorphous silicon (a-Si) material. The charging device 32 charges the circumferential surface 31S of the photosensitive drum 31 uniformly, and includes a charging roller being in contact with the photosensitive drum 31. The exposure device includes a laser light source and an optical device such as mirror and lens for irradiating the circumferential surface 31S of the photosensitive drum 31 with beams of light to form an electrostatic latent image, the light having been modulated in accordance with image data received from an external device such as personal computer.

The developing device 33 supplies toner to the circumferential surface 31S of the photosensitive drum 31 to develop an electrostatic latent image formed on the photosensitive drum 31 into a toner image. The developing device 33 includes a developing roller 36 (developer carrier) including a circumferential surface 36S for carrying toner to be supplied to the photosensitive drum 31, and a first conveying screw 37 and a second conveying screw 38 for circulatively conveying developer in a development housing while stirring it. In the present embodiment, the developing roller 36 is in the form of a magnet roller. The developing roller 36 will be described in detail later.

The transfer roller 34 is used for transferring a toner image formed on the circumferential surface 31S of the photosensitive drum 31 onto a sheet. A transfer bias is applied to the transfer roller 34, the transfer bias having a polarity opposite to that of toner. The cleaning device 35 cleans the circumferential surface 31S of the photosensitive drum 31 after a toner image is transferred therefrom onto a sheet, and conveys remaining toner collected by the cleaning to an unillustrated collection bottle.

The fixing section 40 performs fixing processing of fixing a transferred toner image on a sheet. The fixing section 40 includes a fixing roller 41 having a built-in heating source, and a pressing roller 42 which is brought into pressure contact with the fixing roller 41 to define a fixing nip with the fixing roller 41 therebetween. A sheet having a toner image transferred thereon passes through the fixing nip where the toner image is heated by the fixing roller 41 and pressed by the pressing roller 42 to be fixed on the sheet.

The toner container 50 stores toner to be supplied to the developing device 33. The toner container 50 includes a container body serving as a main storage of toner, and a cylinder section projecting from a lower part of one side of the container body. A toner discharge port 521 is provided in a lower surface of the leading end of the cylinder section, through which toner is supplied to the developing device 33.

The main housing 10 includes therein a main conveyance passage 22F and a reverse conveyance passage 22B for conveyance of a sheet. The main conveyance passage 22F extends from the sheet feeder 21A of the sheet feeding section 20 to a sheet discharge port 14 through the image forming section 30 and the fixing section 40, the sheet discharge port 14 facing the sheet discharge section 13 disposed on the upper surface of the main housing 10. The reverse conveyance passage 22B is used for, in the case where a sheet is subjected to double-sided printing, returning the sheet having one side printed to the upstream side of the image forming section 30 in the main conveyance passage 22F.

A pair of register rollers 23 is disposed at the upstream side of the transfer nip in the main conveyance passage 92F. A sheet is temporally stopped by the pair of register rollers 23 to be subjected to skew correction, and then fed into the transfer nip at a predetermined timing for image transfer. A plurality of conveying rollers for conveying a sheet is disposed at appropriate positions in the main conveyance passage 22F and the reverse conveyance passage 22B. For example, a pair of discharge rollers 24 is disposed near the sheet discharge port 14.

Figure 2:
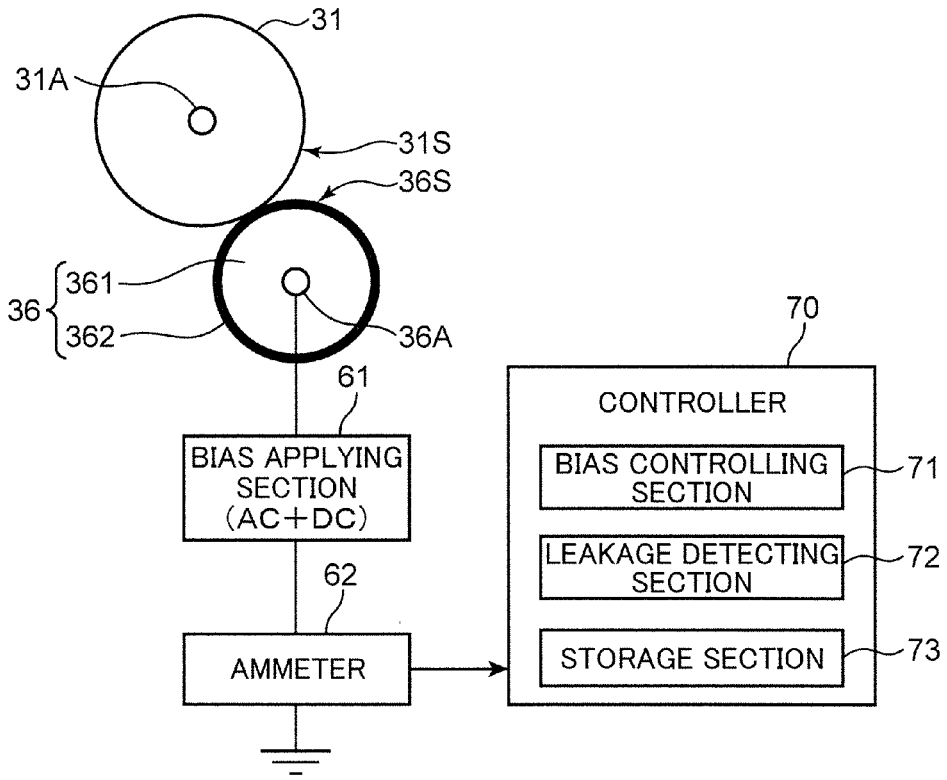
FIG. 2 is a block diagram showing an electrical configuration of a developing device.

Now a configuration related to the developing device 33 will be described in detail with reference to FIG. 2. The developing device 33 includes the developing roller 36 having a magnetic member therein and disposed at a predetermined distance from the photosensitive drum 31, the distance defining a development gap. The developing roller 36 carries developer containing toner on the circumferential surface 36S in the form of a layer of magnetized filaments, and supplies toner from the layer of magnetized filaments to the circumferential surface 31S of the photosensitive drum 31 for development of an electrostatic latent image. The developing roller 36 includes a stationary magnetic roll 361 having a metallic center shaft 36A and a plurality of magnetic members disposed around the center shaft 36A, and a sleeve 362 fitted on the magnetic roll 361 and rotatable around the center shaft 36A. The image forming apparatus 1 further includes a bias applying section 61, an ammeter 62, and a controller 70 for controlling a development bias to be applied to the developing roller 36.

The magnetic roll 361 includes the plurality of magnets fixedly disposed around the center shaft 36A, the plurality of magnets including an attracting pole for attracting toner upward from the development housing, a restricting pole for restricting a layer thickness of the layer of magnetized filaments, and a main pole facing the photosensitive drum 31. The sleeve 362 is in the form of a hollow cylinder made of a non-magnetic material such as aluminum alloy. A flange gear is mounted on an axial end of the sleeve 362 for receiving a torque. The layer of magnetized filaments is carried on an outer surface of the sleeve 362 (the circumferential surface 36S).

Figure 3:
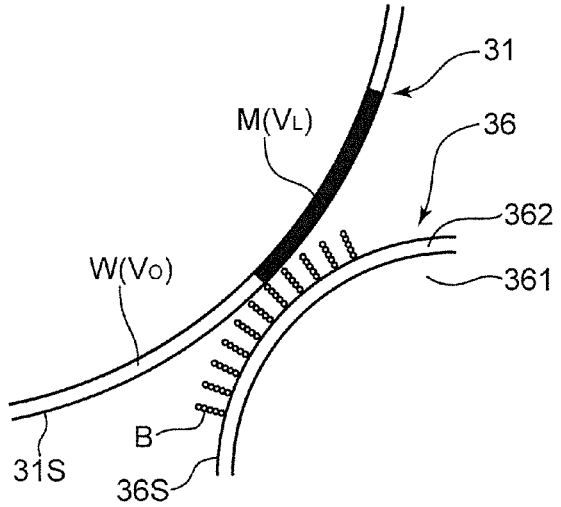
FIG. 3 is a schematic view illustrating a layer of magnetized filaments.

FIG. 3 is a schematic view illustrating the layer of magnetized filaments. A magnetic force exerted by the magnetic roll 361 causes a large number of magnetized filaments B standing on the circumferential surface 36S of the sleeve 362. While the developing device 33 is in operation, the development gap between the circumferential surface 36S and the circumferential surface 31S of the photosensitive drum 31 is filled by these magnetized filaments B. The magnetized filaments B consist of toner in the case where the developer is of a magnetic one-component type, and consist of a carrier and toner in the case where the developer is of a two-component type. An appropriate development bias is set to supply toner particles from the magnetized filaments B to the circumferential surface 31S of the photosensitive drum 31.

The bias applying section 61 includes a direct current power circuit and an alternating current power circuit, and applies a development bias to the developing roller 36, the development bias including a direct current voltage VmgDC and an alternating current voltage VmagAC that are superposed on each other. As shown in FIG. 3, the circumferential surface 31S of the photosensitive drum 31 includes an imaging region M (electrostatic latent imaging region) and a blank region W. The imaging region M refers to a region having been exposed and the blank region W refers to a region having not been exposed after the charging of the circumferential surface 31S by the charging device 32. The exposed imaging region M has a surface potential VL lower than a surface potential V0 of the blank region W. In the case where toner having a positive chargeability is used, the bias applying section 61 sets the direct current voltage Vmag DC to an appropriate value between the surface potential V0 and the surface potential VL and sets a peak-to-peak voltage Vpp of the alternating current voltage VmagAC to an appropriate value to thereby allow toner particles to move away from the magnetized filaments B through the development gap onto the imaging region M (for development).

The ammeter 62 detects a leakage current flowing through a bias circuit of the developing roller 36. The ammeter 62 is used for detecting a leakage voltage causing a discharge between the photosensitive drum 31 and the developing roller 36.

The controller 70 controls the development bias for the image formation and the operation for the leakage voltage detection. The controller 70 is configured as a microcomputer including a built-in storage having a ROM for storing a control program and a flash memory for temporarily storing data, the controller 70 including a bias controlling section 71, a leakage detecting section 72, and a storage section 73 which are executed in accordance with the control program.

The bias controlling section 71 controls the bias applying section 61 to control the development bias to be applied to the developing roller 36. Specifically, the bias controlling section 71 controls a voltage value of the direct current voltage VmagDC, and the peak-to-peak voltage Vpp, an alternating current frequency f, and a duty cycle of the alternating current voltage VmagAC.

In the image formation, the bias controlling section 71 applies to the developing roller 36 a development bias that is determined based on various conditions (the place of use, temperature and humidity, sheet type, and the like). However, an appropriate development bias varies depending on environmental conditions and changes of the apparatus due to aging. Accordingly, the controller 70 causes the leakage detection of detecting a leakage voltage between the photosensitive drum 31 and the developing roller 36 to be performed at a predetermined timing. In the leakage detection, the bias controlling section 71 gradually increases the peak-to-peak voltage Vpp of the alternating current voltage VmagAC (for example, in 50 volts increments) from a predetermined leakage detection starting voltage to cause a discharge between the photosensitive drum 31 and the developing roller 36. In other words, the bias controlling section 71 gradually increases the development bias so that occurrence of a discharge between the photosensitive drum 31 and the developing roller 36 can be detected.

After a leakage voltage is detected when the discharge occurs, the bias controlling section 71 determines a peak-to-peak voltage Vpp of the alternating current voltage VmagAC according to the leakage voltage. For example, the peak-to-peak voltage Vpp is set to a value lower than the leakage voltage by 50 volts. The determined peak-to-peak voltage Vpp is used as the development bias for the succeeding image formation. The present embodiment is characterized in that the frequency of the alternating current voltage VmagAC is also changed according to the change of the peak-to-peak voltage Vpp. This feature will be described later in detail.

The leakage detecting section 72 causes, for the leakage detection, the bias controlling section 71 to perform the above-described control of gradually increasing the peak-to-peak voltage Vpp to cause a discharge. Thereafter, the leakage detecting section 72 detects a leakage voltage when the discharge occurs. The leakage voltage detection is performed based on a measurement result (detection result of a leakage current) obtained by the ammeter 62. Because the voltage generated by the discharge can vary, it is preferred to perform the leakage detection several times. In this case, the leakage detecting section 72 specifies, for example, the average or minimum value of leakage voltages obtained by the detections as the leakage voltage to be derived. The bias controlling section 71 sets, for the developing operation, the peak-to-peak voltage Vpp to a value lower than the specified leakage voltage.

The storage section 73 stores a table allocated with frequencies of the alternating current voltage VmagAC according to varied peak-to-peak voltages Vpp (amplitudes) of the alternating current voltage VmagAC. FIGS. 4 and 5 each show an example of the table. The bias controlling section 71 sets a peak-to-peak voltage Vpp based on a leakage voltage detected by the leakage detecting section 72, and then determines a frequency corresponding to the peak-to-peak voltage Vpp in accordance with the table stored in the storage section 73.

Hereinafter, the significance of changing the frequency according to the change of the peak-to-peak voltage Vpp will be described. In the method of developing an electrostatic latent image on the photosensitive drum 31 by the layer of magnetized filaments carried on the developing roller 36 as in the present embodiment, if the peak-to-peak voltage Vpp of the alternating current voltage VmagAC fails to be set to an appropriate value, an image to be formed is liable to have low quality. Specifically, if the peak-to-peak voltage Vpp is higher than an appropriate value, fogging is liable to occur. Further, if the peak-to-peak voltage Vpp is lower than the appropriate value, ghosting is liable to occur on an image formed after a revolution of the developing roller 36.

Fogging is liable to occur due to excessively promoted movements of toner particles between the circumferential surface 31S of the photosensitive drum 31 and the circumferential surface 36S of the developing roller 36 (see FIG. 3), the excessive promotion being caused by setting an excessively high peak-to-peak voltage Vpp. When the peak-to-peak voltage Vpp is high, the phenomena are liable to occur that toner particles less movable from the circumferential surface 36S to the circumferential surface 31S are likely to move to the circumferential surface 31S, and that toner particles are likely to arrive the circumferential surface 31S undesirably early, and to be hard to be transferred from the circumferential surface 31S after having once adhered on the circumferential surface 31S. As a result of these phenomena, excessive toner particles are liable to be adhered to the circumferential surface 31S, which may result in fogging on an image.

Occurrence of ghosting is related to the degree of adhesion of toner to the circumferential surface 36S of the developing roller 36. The present embodiment employing the developing method using a magnetic one-component developer or a two-component developer does not include a configuration for removing a layer of unused toner from the circumferential surface 36S of the developing roller 36, the configuration using a non-magnetic one-component development. Therefore, the adhesion of toner to the circumferential surface 36S affects an image formed after a revolution of the developing roller 36. Specifically, toner is consumed on the region of the circumferential surface 36S that corresponds to the imaging region M of the photosensitive drum 31, whereas a layer of toner remains on the region of the circumferential surface 36S that corresponds to the blank region W. The region of the circumferential surface 36S corresponding to the imaging region M has a potential equal to the development bias, whereas the region of the circumferential surface 36S corresponding to the blank region W where the layer of remaining toner exists has a potential higher than the development bias due to the remaining toner. Because of this potential difference, an image formed after a revolution of the developing roller 36 is liable to have a high image density in the region that corresponds to the blank region W, which may result in ghosting. When the peak-to-peak voltage Vpp is too low, the movement of toner particles between the circumferential surface 31S and the circumferential surface 36S is liable to be insufficient, which may result in noticeable ghosting especially in the case where the image is a halftone image.

For the above-described reasons, it is important, in order to prevent both fogging and ghosting, that the peak-to-peak voltage Vpp be not so high as to cause fogging and not so low as to cause noticeable ghosting. However, in conventional developing devices of this type, after a leakage voltage is detected in the above-described leakage detection, only the peak-to peak voltage Vpp is set to a value lower than the leakage voltage while keeping the frequency unchanged in order to avoid image degradation caused by the discharge. Therefore, there have been cases where the peak-to-peak voltage Vpp was set to a value that was inappropriate in terms of suppression of fogging and ghosting.

The persons who worked out the present disclosure found that it is possible to prevent fogging and ghosting by changing the frequency of the alternating current voltage VmagAC in addition to the peak-to-peak voltage Vpp of the alternating current voltage VmagAC according to the change in the peak-to-peak voltage Vpp. In terms of prevention of fogging, it is effective to increase the frequency as the peak-to-peak voltage Vpp increases. This is because an increase in the frequency leads to an increase in the proportion of toner particles moving in the gap (development region) between the circumferential surface 31S and the circumferential surface 36S, which consequently prevents toner movement from the circumferential surface 31S to the circumferential surface 36S. In terms of prevention of ghosting, it is effective to decrease the frequency as the peak-to-peak voltage Vpp decreases. This is because a decrease in the frequency ensures a time for toner particles to move appropriately in the development region to appropriately perform reciprocating movement between the circumferential surface 31S and the circumferential surface 36S, which results in promotion of the movement of toner particles to the circumferential surface 31S.

FIG. 4 is a table showing a relationship between peak-to-peak voltages Vpp and frequencies of the alternating current voltage VmagAC and image qualities in the case of using a magnetic one-component developer. In FIG. 4, the "fogging NG zone" indicates the combinations of peak-to-peak voltages Vpp and frequencies that cause fogging on an image, the "ghosting NG zone" indicates the combinations of peak-to-peak voltages Vpp and frequencies that cause noticeable ghosting. The "image OK zone" lying between the "fogging NG zone" and the "ghosting NG zone" in the form of a strip indicates the combinations of peak-to-peak voltages Vpp and frequencies that allow acquisition of a high quality image while preventing both fogging and ghosting. The "image OK zone" has a characteristic relationship where the frequency increases as the peak-to-peak voltage Vpp (amplitude) increases. Further, when the peak-to-peak voltage Vpp is less than a specific value, release of toner particles itself is so insufficient as to result in insufficient image density, regardless of the frequency. Accordingly, the relevant zone is indicated as "insufficient density NG zone" in FIG. 4.

For example, in the case where the alternating current voltage VmagAC of the development bias is set to have a peak-to-peak voltage Vpp of 1.6 kV and a frequency of 1.9 kHz, and a leakage is caused to occur at a peak-to-peak voltage Vpp of 1.3 kV by the leakage detection, the bias controlling section 71 sets a peak-to-peak voltage Vpp of 1.2 kV in the succeeding developing operation. Here, if the frequency of 1.9 kHz is kept unchanged, the alternating current voltage VmagAC belongs to the "ghosting zone", which is liable to result in an image of lower quality. In contrast, if the frequency is changed to, for example, 1.5 kHz in accordance with FIG. 4, the alternating current voltage VmagAC belongs to the "image OK zone".

Based on the characteristic relationship of the "image OK zone" in the case of using the magnetic one-component developer, the relationship between the peak-to-peak voltage Vpp (kV) and the frequency f (kHz) can be generally expressed by the following formula:

$$\text{Frequency } f(\text{kHz}) = (1.15 \sim 1.65) \times \text{Peak-to-Peak Voltage } Vpp\ (\text{kV})$$

It is possible to set a frequency corresponding to the environment by multiplying the above relational expression by a correction coefficient corresponding to an environmental condition such as atmospheric pressure. Further, the charging amount of toner is liable to increase due to long-term use of the developing device 33. Accordingly, it is preferred to perform frequency correction according to a cumulative development time.

FIG. 5 is a table showing a relationship between peak-to-peak voltages Vpp and frequencies of the alternating current voltage VmagAC and image qualities in the case of using a two-component developer. The "fogging NG zone", "ghosting NG zone" "image OK zone" and "insufficient density NG zone" are defined in the same manner as the case of FIG. 4. The "image OK zone" in the case of using a two-component developer also has a characteristic relationship where the frequency increases as the peak-to-peak voltage Vpp increases.

In the case of using a two-component developer, the height of the magnetized filaments is higher than in the case of using a magnetic one-component developer because of the existence of carrier. Therefore, the actual distance over which toner particles can move in the development region is shorter than in the case of using a magnetic one-component developer, the development region being defined by the development gap between the circumferential surface 31S and the circumferential surface 36S. In order to activate the reciprocating movement of toner particles over such a short distance, it is necessary to set the frequency of the alternating current voltage Vmag AC to a high value in the case of using a two-component developer. Based on the characteristic relationship of the "image OK zone" in the case of using a two-component developer shown in FIG. 5, the relationship between the peak-to-peak voltage Vpp (kV) and the frequency f (kHz) can be generally expressed by the following formula:

$$\text{Frequency } f(\text{kHz}) = (2.0 \sim 4.5) \times \text{Peak-to-Peak Voltage } Vpp\ (\text{kV})$$

It is preferred to multiply the above relational expression by the coefficient for correcting the frequency that corresponds to an environmental condition, a cumulative development time, or the like.

The above relational expression serves as a standard in the case where the development gap Ds between the circumferential surface 31S and the circumferential surface 36S falls within the range of 0.2 mm to 0.45 mm and the filling proportion of developer in the development region is 20% or less, preferably 10% or less. The developer filling proportion p (%) indicates how much developer is filled in the development region, which can be expressed by the following formula:

$$p(\%)=m/(\rho\times Ds)\times 100$$

wherein ρ (g/cm3) represents a true specific gravity of developer, Ds (cm) represents the development gap, and m (g/cm2) represents a developer conveyance amount in the development region.

In the following, two ways in which the bias controlling section 71 causes the development bias to change for the leakage detection are illustrated.

(First Way) The peak-to-peak voltage Vpp is gradually increased to cause a discharge in the development gap while keeping the frequency unchanged. When a leakage voltage is detected, a peak-to-peak voltage Vpp for the developing operation is determined. Subsequently, a frequency that falls in the "image OK zone" is determined in accordance with FIG. 4 or FIG. 5 (either one of the tables in the storage section 73).

(Second Way) The peak-to-peak voltage Vpp is gradually increased and, at the same time, the frequency of the alternating current voltage VmagAC is also changed. As for the frequency, a frequency that falls in the "image OK zone" is selected correspondingly to the peak-to-peak voltage Vpp in accordance with FIG. 4 or FIG. 5 (either one of the tables in the storage section 73). Subsequently, a peak-to-peak voltage Vpp for the developing operation is determined. The frequency that is associated with the peak-to-peak voltage Vpp at the time of leakage voltage detection is selected.

The above-described First Way allows selection of a frequency corresponding to the peak-to-peak voltage Vpp, which makes it possible to prevent occurrence of fogging and ghosting. However, according to Second Way, the amplitude and the frequency of the alternating current voltage VmagAC are changed concurrently for the leakage voltage detection, which makes it possible to further improve the detection accuracy of the leakage voltage. This is because the change in the frequency leads to a change in the application time of the peak-to-peak voltage Vpp and consequently to improved resolution for the detection of the leakage voltage. Because the peak-to-peak voltage Vpp for the developing operation is determined based on the leakage voltage, if the leakage voltage is detected at a high accuracy, the bias controlling section 71 is allowed to set a more appropriate development bias, which leads to improvement in the image quality.

Now, a way of setting a development bias that is to be applied to the developing roller 36 for the leakage detection will be described. The leakage detecting section 72 performs the leakage voltage detection in the blank region W (FIG. 3) where no electrostatic latent image is formed on the circumferential surface 31S of the photosensitive drum 31. This is because, in the developing method of the present embodiment in which an electrostatic latent image is developed by means of the magnetized filaments B, it is necessary to perform the leakage detection with the magnetized filaments B existing in the development gap in order to achieve accurate leakage voltage detection. If the leakage detection is attempted to be performed in the imaging region M, toner will be so consumed that a part or an entirety of the magnetic filaments B will disappear and, consequently, accurate leakage voltage detection will no longer be able to be achieved.

The bias controlling section 71 sets a development bias so that the leakage voltage detection can be performed in the blank region W. The reversal developing method is employed in the present embodiment including the leakage detection. The reversal development refers to a method of adhering, for example, toner having a positive chargeability to the circumferential surface 31S of the photosensitive drum 31 that is positively charged, by using a potential difference therebetween. In this method, for example, the positive surface potential (potential charged by the charging device 32) of the circumferential surface 31S is set to a value higher than the positive surface potential (direct current voltage VmagDC of the development bias) of the circumferential surface 36S of the developing roller 36. Consequently, an electric force (collecting force) is generated which causes remaining toner particles adhered to the circumferential surface 31S to move to the circumferential surface 36S. On the other hand, toner particles remain adhered to the region (imaging region M) of the circumferential surface 31S that has been made to have a positive surface potential lower than the direct current voltage VmagDC by exposure. In this manner, an electrostatic latent image is developed.

Under the above-described conditions of the reversal development, the bias controlling section 71 sets, for the leakage detection, the direct current voltage VmagDC of the development bias so as to satisfy the following relationship:

$$|VmagDC|<|V0|$$

wherein V0 represents the surface potential of the blank region W of the circumferential surface 31S. In addition, the bias controlling section 71 sets the duty cycle of the alternating current voltage VmagAC to 50%. Under these settings, the bias controlling section 71 gradually increases the peak-to-peak voltage Vpp from a predetermined leakage detection starting voltage for the leakage detection.

Figure 6:
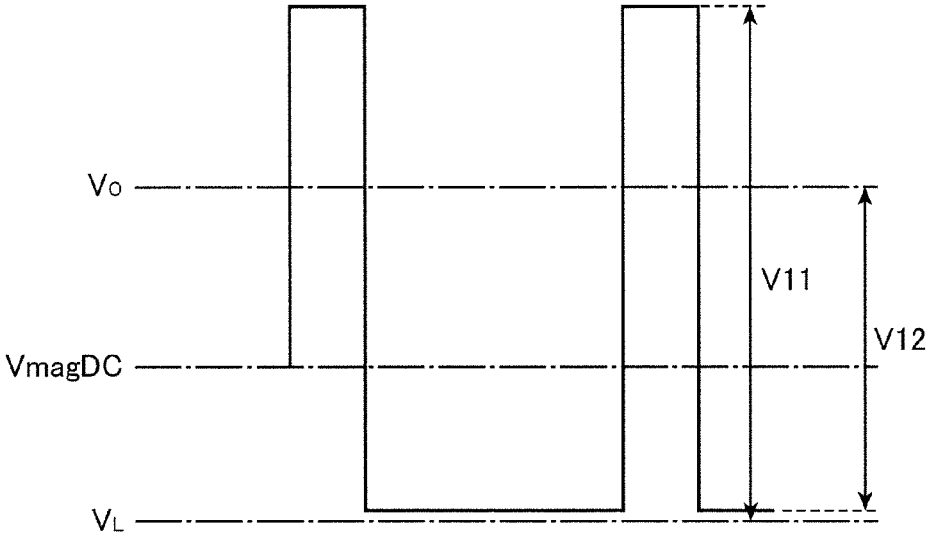
FIG. 6 is a diagram showing an ordinary waveform of a development alternating current voltage.
Figure 7:
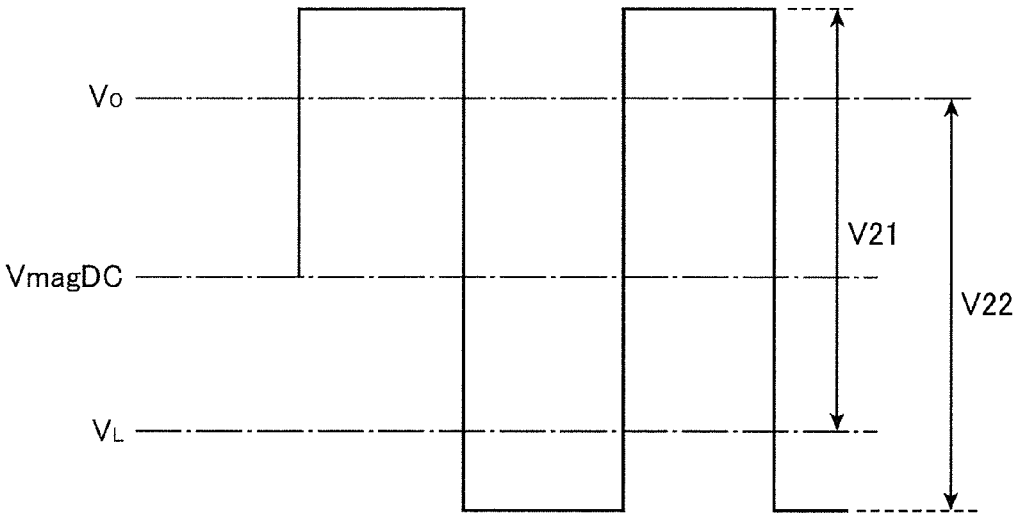
FIG. 7 is a diagram showing a waveform of a development alternating current voltage preferred in the present disclosure.

FIG. 6 is a diagram showing a waveform of an alternating current voltage VmagAC adopted in other developing methods, and FIG. 7 is a diagram showing a waveform of the alternating current voltage VmagAC adopted in the present embodiment. In these diagrams, VL denotes the surface potential of the imaging region M, and V0 denotes the surface potential of the blank region W. The waveform shown in FIG. 6 represents a duty cycle of about 25%. In this case, a voltage V12 involved in leakage in the blank region W is considerably lower than a voltage V11 involved in leakage in the imaging region M. Such relationship of the voltages implies that the alternating current voltage VmagAC having such a duty ratio as shown in FIG. 6 is liable to cause leakage in the imaging region M. However, in the developing method of the present embodiment using the magnetized filaments as described above, it is necessary to perform the leakage detection in the blank region W because the accuracy of the leakage detection is not high in the imaging region M. This therefore requires the leakage detection to be performed in the blank region W to infer a voltage that causes leakage in the imaging region M from the detected value and set an alternating current voltage VmagAC. However, under the condition that the difference between the voltage V11 and the voltage V12 is great as shown in FIG. 6, it is liable to infer a voltage that causes leakage in the imaging region M with a large error.

In contrast, in the case where the alternating current voltage VmagAC has a duty cycle of 50% as shown in FIG.

7, there is no great difference between a voltage V21 involved in leakage in the imaging region M and a voltage V22 involved in leakage in the blank region W. Therefore, even if the leakage detection is performed in the blank region W to infer a voltage that causes leakage in the imaging region M from the detected value and set an alternating current voltage VmagAC, no large error is likely to occur. Therefore, it is preferred to use an alternating current voltage VmagAC having a duty cycle of 50% in the present embodiment.

Working Examples are shown in the following. The following conditions are set for the image formation in the image forming apparatus 1.

[Sheet print speed] 25 sheets/minute
[Circumferential speed of photosensitive drum] 146 mm/second
[Development gap Ds] 0.3 mm
[Surface potential of photosensitive drum] Blank region: V0 = +420 V; Imaging region: VL = +100 V
[Development bias] VmagDC = +270 V; Duty cycle of VmagAC = 50%
[Toner] Particle diameter of 6.8 μm; positive chargeability
[Toner conveyance amount] 0.9 mg/cm$^2$
[Developing method] Magnetic one-component development
[Ratio of circumferential speed of photosensitive drum to that of developing roller] 1:1.4

As Working Example 1, a development bias was set in the way (the above-described "First Way") of performing the leakage voltage detection while keeping a frequency unchanged and determining a peak-to-peak voltage Vpp based on an obtained leakage voltage, and subsequently changing the frequency of the alternating current voltage VmagAC according to the determined peak-to-peak voltage Vpp. As Comparative Example 1, another peak-to-peak voltage Vpp was determined in the same manner, but a development bias was set while keeping a frequency unchanged before and after the leakage detection. Thereafter, in each of Working Example 1 and Comparative Example 1, the image formation was performed based on the set development bias to evaluate occurrence of ghosting in an obtained image. The same evaluation testing was performed once under the environmental condition of 1 atmospheric pressure and once under the environmental condition of 0.75 atmospheric pressure in order to evaluate the influence of changes in atmospheric pressure on the appropriate relationship between the peak-to-peak voltages Vpp and the frequencies. The result is shown in Table 1.

TABLE 1

| | At the time of Leakage Detection | | After Leakage Detection | | | | |
|---|---|---|---|---|---|---|---|
| | | | | Frequency (kHz) | | Ghosting | |
| Atmospheric Pressure | VmagAC (V) | Frequency (kHz) | VmagAC (V) | Comparative Example 1 | Working Example 1 | Comparative Example 1 | Working Example 1 |
| 1 | 2000 | 3.3 | 1950 | 3.3 | 2.73 | Δ | ○ |
| 0.75 | 1700 | 3.3 | 1650 | 3.3 | 2.31 | x | ○ |

Figure 8A:
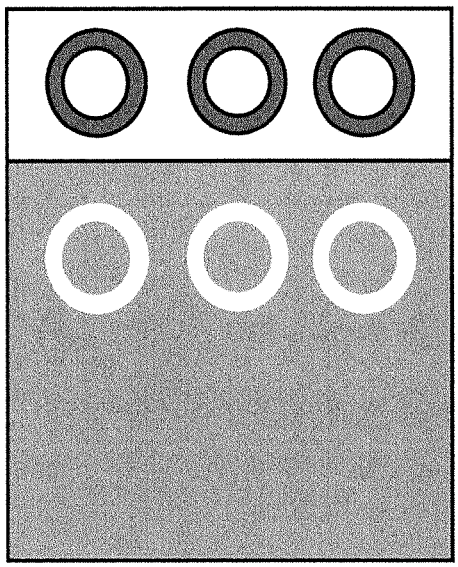
FIGS. 8A and 8B are diagrams each showing an image for evaluating occurrence of ghosting.
Figure 8B:
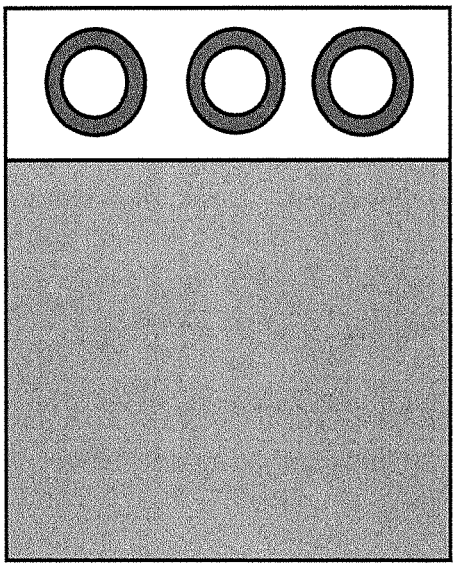

FIGS. 8A and 8B each show an image for evaluating ghosting. FIG. 8A shows an image having ghosting, and FIG. 8B shows an image having no ghosting. In these images, a lower portion was located upstream in the sub-scanning direction. As shown in FIG. 8A, ghosting is liable to occur in a half-tone image after a revolution of the developing roller 36. In Table 1, the evaluation of ghosting is indicated in the following three grades in the columns under "Ghosting".

○: No ghosting
Δ: Slight ghosting
x: Heavy ghosting

Table 1 confirms that according to Working Example 1, no ghosting is likely to occur.

As Working Example 2, a development bias was set in the way (the above-described "Second Way") of performing the leakage voltage detection by increasing a peak-to-peak voltage Vpp concurrently with a frequency of the alternating current voltage VmagAC, and determining a peak-to-peak voltage Vpp and a frequency based on an obtained leakage voltage. As Comparative Example 2, the leakage voltage detection was performed while keeping a frequency unchanged, and a development bias was set by determining a peak-to-peak voltage Vpp based on an obtained leakage voltage while keeping the frequency unchanged. In the leakage detection, the same leakage detection was repeated three times to calculate the mean value of the leakage voltages obtained in the detections, and a voltage lower than the calculated mean value by 50V was set as a peak-to-peak voltage Vpp. The result is shown in Table 2.

TABLE 2

| | At the time of Leakage Detection | | After Leakage Detection | |
|---|---|---|---|---|
| | Mean of Detected Voltages (V) | Frequency (kHz) | Set Voltage (V) | Frequency (kHz) |
| Comparative Example 2 | 2030 | 2.0 | 1980 | 2.0 |
| Working Example 2 | 2100 | 2.0~2.7 | 2050 | 2.56 |

In Table 2, the frequency of Working Example 2 at the time of leakage detection is written as "2.0~2.7" (kHz), which indicates that the frequency was changed within this range when the peak-to-peak voltage Vpp was increased for the leakage detection. As shown in Table 2, a higher leakage voltage was detected in Working Example 2 than in Comparative Example 2. This was because the application time of the alternating current voltage VmagAC was shortened due to the increase in the frequency along with the increase in the peak-to-peak voltage Vpp, so that leakage was less liable to occur than in Comparative Example 2 in which the leakage detection was performed while keeping the frequency unchanged. It can alternatively be said that the accuracy of the leakage voltage detection was improved by the setting of an appropriate frequency according to the change in the peak-to-peak voltage Vpp. Anyway, according to Working Example 2, it is possible to detect a relatively higher leakage voltage, based on which a peak-to-peak voltage Vpp for the development is determined, and therefore to set a development bias having the higher peak-to-peak voltage Vpp. Because a high peak-to-peak voltage Vpp is advantageous in terms of improvement in image quality, Working Example 2 is considered more preferred.

As described above, according to the present embodiment, it is possible to set an appropriate development bias in the image forming apparatus employing the developing method of supplying developer from the developing roller 36 carrying the layer of magnetized filaments to the circumferential surface 31S of the photosensitive drum 31. Therefore, the image forming apparatus 1 capable of maintaining a high image quality can be provided.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image carrier including a circumferential surface for carrying an electrostatic latent image and a toner image;

a developer carrier including a magnetic member therein and a circumferential surface for carrying a developer containing toner in the form of a layer of magnetized filaments to supply toner from the layer of magnetized filaments to the image carrier for development of the electrostatic latent image;

a bias applying section for applying to the developer carrier a development bias including a direct current voltage VmagDC and an alternating current voltage VmagAC that are superposed on each other;

a leakage detecting section for causing a discharge between the image carrier and the developer carrier and detecting a leakage voltage when the discharge occurs;

a bias controlling section for controlling the development bias for the image formation and the leakage voltage detection, and a storage section storing a table allocated with frequencies of the alternating current voltage VmagAC according to varied amplitudes of the alternating current voltage VmagAC, the table identifying in advance a zone that indicates the combination of the alternating current voltage VmagAC and the frequencies that allow acquisition of a high quality image while preventing both fogging and ghosting and a correction coefficient corresponding to an environmental condition including atmospheric pressure, wherein the leakage detecting section performs the leakage voltage detection in a blank region of the image carrier, the blank region bearing no electrostatic latent image, the bias controlling section controls the development bias to change based on a leakage voltage by determining an alternating current voltage VmagAC according to a detected leakage voltage and determining a frequency of the alternating current voltage VmagAC according to the alternating current voltage VmagAC and the coefficient, and the bias controlling section causes, when the leakage detecting section performs the leakage voltage detection, an amplitude of the alternating current voltage VmagAC and a frequency of the alternating current voltage VmagAC to be changed in accordance with the table, and wherein the bias controlling section sets:

a frequency of the alternating current voltage VmagAC by multiplying a relational expression (1) by the correction coefficient in a case where the developer is a magnetic one-component developer, $$\text{Frequency } f(\text{kHz}) = (1.15 \sim 1.65) \times \text{Peak-to-Peak Voltage } Vpp\ (\text{kV}) \quad (1),$$

and a frequency of the alternating current voltage VmagAC by multiplying a relational expression (2) by the correction coefficient in a case where the developer is a magnetic two-component developer, $$\text{Frequency } f(\text{kHz}) = (2.0 \sim 4.5) \times \text{Peak-to-Peak Voltage } Vpp\ (\text{kV}) \quad (2),$$

as Vpp being peak-to-peak voltage of the alternating current voltage VmagAC.

2. An image forming apparatus according to claim 1, wherein the bias controlling section sets, for the leakage voltage detection, a condition for reversal development in which toner is electrically moved from the circumferential surface of the image carrier to the circumferential surface of the developer carrier, and establishes the following relationship: $|VmagDC| < |V0|$ where V0 represents a surface potential of the blank region.

3. An image forming apparatus according to claim 2, wherein the bias controlling section sets, when the leakage detecting section performs the leakage voltage detection, a duty cycle of the alternating current voltage VmagAC at 50%.

4. An image forming apparatus according to claim 1, wherein the amplitudes and the frequencies of the alternating current voltage VmagAC are in a relationship where the frequency increases as the amplitude increases.

5. An image forming apparatus according to claim 1, wherein the developer is a magnetic one-component developer or a two-component developer consisting of toner and carrier.

* * * * *